US006176862B1

(12) United States Patent
Delay et al.

(10) Patent No.: US 6,176,862 B1
(45) Date of Patent: Jan. 23, 2001

(54) HAIR-REMOVING DEVICE WITH ROTARY ROLLER EQUIPPED WITH PAIN-SOOTHING DEVICE

(75) Inventors: Jean-Pascal Delay, Ecully; Daniel Bontoux, Saint Genis Laval; Yves Rosson, Villars les Dombes; Muriel Cathaud, Toussieu, all of (FR)

(73) Assignee: SEB, Ecully (FR)

( * ) Notice: Under 35 U.S.C. 154(b), the term of this patent shall be extended for 0 days.

(21) Appl. No.: 09/308,206

(22) PCT Filed: Sep. 15, 1998

(86) PCT No.: PCT/FR98/01963

§ 371 Date: May 12, 1999

§ 102(e) Date: May 12, 1999

(87) PCT Pub. No.: WO99/13750

PCT Pub. Date: Mar. 25, 1999

(30) Foreign Application Priority Data

Sep. 16, 1997 (FR) ..... 97 11728

(51) Int. Cl.[7] ..... A61B 17/50
(52) U.S. Cl. ..... 606/133
(58) Field of Search ..... 606/133, 210, 606/211

(56) References Cited

U.S. PATENT DOCUMENTS 4,161,050 * 7/1979 Sasaki et al. ..... 15/159
5,084,055 * 1/1992 Demeester ..... 606/133
5,108,410 * 4/1992 Iwasaki et al. ..... 606/133
5,197,969 * 3/1993 Visscher et al. ..... 606/133
5,281,233 * 1/1994 Dolev ..... 606/133
5,441,506 * 8/1995 Gabion et al. ..... 606/133
5,893,854 * 4/1999 Bontoux et al. ..... 606/133
5,916,222 * 6/1999 Iwasaki et al. ..... 606/133

FOREIGN PATENT DOCUMENTS

467733 * 1/1992 (EP) ..... 606/133
671 136 9/1995 (EP) .
405168523 * 7/1993 (JP) ..... 606/133
97/00032 1/1997 (WO) .

* cited by examiner

*Primary Examiner*—John J. Wilson
*Assistant Examiner*—Eduardo C. Robert
(74) *Attorney, Agent, or Firm*—Browdy and Neimark

(57) ABSTRACT

A hair-removing device composed of a hair-removal roller driven in rotation by a motor around an axis of rotation arranged behind a housing window, a control mechanism for successively leading tweezing blades to close against one another in order to tweeze hairs to be plucked and then to separate from one another and a pain-soothing device composed of elements mounted on the roller. The elements are mounted in a fixed position on the roller and each element has at least one protuberance extending beyond a virtual cylinder coaxial with said roller and in which are inscribed said tweezing edges of said tweezing blades, and each protuberance has an outer end that is inclined or rounded along a plane that is transverse to the axis of rotation of the roller and that passes through the element from which the protuberance extends.

17 Claims, 5 Drawing Sheets

HAIR-REMOVING DEVICE WITH ROTARY ROLLER EQUIPPED WITH PAIN-SOOTHING DEVICE

This application is the national phase of international application PCT/FR98/01963 filed Sep. 15, 1998 which designated the U.S.

TECHNICAL FIELD

The present invention is relative to a hair-removing device capable of being held in the hand and intended to remove with the least pain sensation possible hair from the human body considered to be unnecessary for esthetic or other reasons.

PRIOR ART

A known family of hair-removing devices is based on a roller which is moveable in rotation around an axis arranged behind a window in one of the extremities of the housing, this roller comprising one or several rows of tweezers. Each row of tweezers is formed of a first series of parallel, side-by-side moveable blades, interposed into a second series, either of fixed discs or of equally moveable blades, tweezers thus being constituted by a blade of the first series associated with the adjacent disc or blade of the second series. Provision is also made for control means to successively bring the moveable blades to press against one another, or against the adjacent disc, to pinch the hairs to be plucked, then to move away from one another to permit evacuation of the plucked hairs before introduction of the following hairs between the blades.

Thus, when the roller turns, the tweezers close in proximity to the skin in gripping the hairs which are then entrained and plucked by the continued rotation of the roller. These blades grip and pull the hairs in a random manner, not necessarily in proximity to their roots, so that a hair can be pulled several times before being plucked. These successive pulls and the plucking excite the nerve ends close to the hair follicles and are the cause of the pain sensed during hair removal.

EP Patent No. 467733 (SEB) describes a hair-removing device of the above-described type comprising brushes composed of tufts of bristles on its roller. The extremities of these bristles can project slightly beyond a cylinder inscribed on the tweezing edges of the discs and blades. These bristles are provided to be sufficiently stiff to produce an effect of lifting the hairs to be removed, without however being too stiff in order to not irritate the skin.

During testing of this hair-removing device, it was observed that these brushes have a secondary pain-soothing effect by the fact that these bristles come to "lash" the skin. However, this secondary effect is limited.

The document EP 671136 (SEB) describes another hair-removing device of this type, in which the blades are adjacent, on the one hand to a smooth surface in the form of a section of a cylinder coaxial with the axis of rotation of the roller, and on the other hand to an elongated hollow zone extending parallel to the alignment of the blades, this zone being itself adjacent to another smooth surface in the form of a portion of a cylinder diametrically opposed to the first. These cylinder portions define between them a virtual protection cylinder coaxial with the roller preventing the skin from penetrating into the tweezers.

The hollow zone comprises a series of brushes provided to lift the hairs that are lying flat by contact with the smooth surfaces and thus to improve the gripping of these hairs by the tweezers. This hollow zone comprises in addition, near one of the sides of the blades, a series of spikes parallel to the brushes and the tips of which are situated on the virtual protection cylinder. These spikes prevent the hair-removing roller from jumping onto the skin during passage of the hollow zone and produce on the skin a massaging effect complementary to the brushing which diminishes the pain due to plucking of the hairs. There exists nevertheless a real need for a pain-soothing device which is still more effective in order to render this operation less disagreeable.

The document EP 760219 (MATUSHITA) describes several hair-removing devices with vibrating pain-soothing elements, either in the form of a vibrating comb carried by the housing or in the form of vibrating rollers in addition to the spikes or to the stiff bristles which are equally carried by the housing at the side of the hair-removing roller.

The document WO 97/19613 (PHILIPS) describes a hair-removing device comprising a series of striking spikes of a relatively hard elastomer material, assembled in the manner of a comb or a hand and mounted in a vibrating manner on the housing. The flexibility of the protuberances is such that the latter penetrate into the skin to assure an anesthetic effect, but withdraw and bend when the hair-removing device passes by a boney zone.

However, these pain-soothing devices mounted on the housing at the outside but adjacent to the hair-removing roller cause the appliance to be more complex because they require an independent and complex vibration inducing mechanism. In addition, these external devices hide the zone from which hair is to be removed, which renders the hair-removing operation less easy.

The document WO 97/00032 (BRAUN) describe a hair-removing device whose rotating roller comprises a series of moveable massage elements that are pushed radially toward the outside by centrifugal force and/or by springs in order to come to strike the skin and provoke pulses intended to mask the hair-removal pain. This construction has proven however to be equally complicated, and thus difficult to carry out, and there exists a risk of blocking of the massage elements.

Patent application FR 96.03177 (SEB) describes a plurality of hair-removing devices equipped with a pain-soothing device. According to a first form of construction, the hair-removing roller is itself mounted in a vibrating stirrup. According to a second form of construction, the roller comprises radially moveable massage elements. According to a third form of construction, the roller comprises massage elements in the form of a lever pivotally mounted on the hair-removal roller in such a manner that their extremities come to strike the skin radially. According to a fourth form of construction, the hair-removing device comprises a stirrup surrounding the roller and mounted on the housing in a vibratory manner. These forms of construction have however been found to be equally complicated.

SUMMARY OF THE INVENTION

The object of the present invention is a hair-removing device comprising a hair-removing roller driven in rotation by a motor around an axis arranged behind a window of the housing, this roller comprising one or several rows of tweezing blades to be pressed against one another in order to tweeze the hairs to be plucked then to spread apart, the pain-soothing device of which is efficacious, simple in structure, reliable and inexpensive to produce.

This goal is achieved due to the fact that the pain-soothing device comprises elements mounted in a fixed manner on the rotating wheel, presenting one or several protuberances which extend beyond the virtual cylinder coaxial to the roller in which are inscribed the tweezing edges of the blades, each protuberance being inclined and/or rounded along the plane transverse to the axis of rotation of the roller passing through the fixed element.

The cylinder coaxial to the roller in which are inscribed the tweezing edges of the blades constitutes a type of virtual protection cylinder by the fact that, in this cylinder, there are equally inscribed smooth parts of the roller, either in the form of elongated shells angularly off-set with respect to the blades, or in the form of a series of transverse discs open at the level of the blades, these smooth parts when bearing on the skin preventing the latter from being grasped by the tweezers.

In setting the rounded protuberancies of the fixed elements beyond this virtual protection cylinder in order to thus protrude, one obtains a substantial pain-soothing effect effectively diminishing the pain caused by the plucking of the hairs and this in a simple and solid manner.

Due to this inclined and/or rounded part, it is assured that the part of the protuberance which comes to strike the skin at the peripheral speed of the roller is presented in an oblique and non-perpendicular manner at this skin. This provokes a very pronounced massage effect leading to a pain sensation which masks the hair-removing pain. This inclined and/or rounded part avoids all risks of cuts or bruises.

In the plane transverse to the axis of rotation, the protuberance presents a cross section which is generally convex formed with a continuous curve, for example an arc of a circle, or is formed of a succession of arcs having progressive radii or straight line portions.

In the majority of cases, the angle of attack of the protuberance, i.e. at the level of the zone intersecting the virtual protection cylinder, is less than 60°, and even less than 45°. However, in the case where the protuberance is small, for example less than 0.2 mm, it is possible to envision a larger angle of attack and a more pronounced rounding of the upper edge. Conversely, the greater the protuberance, the more it is advantageous to have a small angle of attack and a slightly rounded upper edge.

In addition, because the elements are fixed on the roller, their action is coupled with that of tweezing with the blades. Notably, when the number of rows of pain-soothing elements is equal to the number of tweezing rows, the frequency of pain-soothing effects is identical to that of hair removal. When the number of rows of pain-soothing elements disposed on the periphery of the roller is different from the number of tweezing rows, the first harmonic of the frequency of the pain-soothing effect remains identical to the first harmonic of the frequency of hair removal which corresponds then to the speed of rotation of the roller.

The base of the lower part and/or the rounding of a protuberance can be situated beyond the coaxial cylinder of the roller in which are inscribed the tweezing edges of the blades. In addition, the rounding of the protuberance is preferably convex, symmetrical in its transverse plane or asymmetrical, i.e. this rounding can present a larger portion downstream or upstream, such as seen with respect to the direction of rotation of the roller.

Due to the choice of this rounded transverse profile, one can refine the characteristics of the mechanical impulsions applied onto the skin, whether this impulsion commences in an abrupt manner or a progressive manner with a starting slope that is more or less steep, in order to obtain some other type of pain better adapted to the configuration of the tweezing blades.

In order to provoke a pain sensation throughout the zone of the skin which is subject to hair removal immediately after, one can arrange a series of pain-soothing elements on the roller in an elongated zone covering substantially the length of the roller, these elements being distributed either along a straight or slightly helical line, or in staggered rows, this zone being angular, off-set from a row of tweezing blades, preferably upstream of the row, as viewed with respect to the direction of rotation of the roller.

The pain-soothing elements can be added on to a part of the roller, or formed in one piece with this part.

The first variant permits one to envision removable elements permitting, in addition, a subsequent replacement of a broken element or an exchange for other removable elements whose protuberances produce different massage effects. The "one-piece" variant offers a possibility of fabrication at a low cost, particularly by a simple modification of the mold pattern of a piece obtained by injection of plastic material.

Preferably, the pain-soothing elements are rigid in order to effectively stimulate the nerve ends of the skin. One can equally envision that these elements are semi-rigid, i.e. flex only starting from a predetermined stress in order to avoid bruising a firmer zone of the body, notably a boney region, covered uniquely by the skin, as for example at the level of the tibia, the elbow or the knee. Only one part, notably a support part, can be flexible to provide this semi-rigidity.

According to a first arrangement, the pain-soothing elements can be present in the form of a radial plate or a bar connected in parallel with the axis of rotation between the lateral cheeks of the roller, the external edge of the plate or of the bar protruding beyond the virtual cylinder being straight, undulating or toothed, the transverse cross section of this edge being rounded.

The pain-soothing plates or bars can then be realized as individual, interchangeable pieces which are assembled in the roller or at the desire of the user.

According to a second arrangement, the pain-soothing elements can be present in the form of protuberances arranged on the circular periphery of the intermediate discs inscribed in the cylinder passing through the edges of the tweezing blades or on the circular periphery of the lateral cheeks of the roller.

In this embodiment, use is made of the intermediate transverse discs which constitute the virtual protection cylinder to arrange the pain-soothing elements in adequate zones.

Another advantage resides in the fact that one can dispose a larger number of pain-soothing elements along the circular periphery than the number of tweezing rows. This permits optimizing the frequency of the pain-soothing effect. In addition, one can dispose pain-soothing elements in an irregular manner in order to produce a particular frequency profile of the pain-soothing effect.

According to a third arrangement, the pain-soothing elements can be present in the form of protuberances arranged on the leading edge or the trailing edge of a tweezing blade. The pain-soothing effect is then provoked practically at the very moment of plucking of the hairs.

In the hair-removing device according to document EP 467733 cited previously, the roller comprises a one-piece body comprising a series of fixed parallel discs and a double series of moveable tweezing discs, the series being diametrically opposite and disposed between the discs. The one-piece body presents, in addition, two diametrically opposed grooves in a plane perpendicular to that passing through the two series of blades. In these grooves can be installed shanks, notably forming pedestals for supporting brushes.

Applicant's patent application FR 97.00224 describes another hair-removing device of an analogous type, in which each row of tweezers is formed of a first series of parallel blades side-by-side, fixed with a central moveable trailer, and interposed into a second series of blades fixed to a cage coaxially surrounding the trailer. Notably, this cage is composed of a plurality of axial shank-pedestals whose extremities are fixed at one side and the other at regular intervals on the periphery of two lateral cheeks bordering the roller, the radially internal face of the pedestals presenting grooves for retaining the base of the blades. In a manner analogous to the preceding hair-removing device, the external sides of these pedestals carry elongated brushes.

Then, and according to a prefered arrangement when the roller comprises peripheral pedestals parallel to the roller axis as mentioned previously, it is found to be particularly advantageous to simply also mount the pain-soothing elements according to the invention along the external side of these pedestals.

In this preferred arrangement, the pain-soothing elements can be a series of spikes individually associated with the base, spikes whose extremities form rounded protuberances extending beyond the virtual cylinder.

These spikes can be inserts positioned in the mold before fabrication of a pedestal by injection of plastic material. Alternatively, the molded pedestals can present a row of orifices into which the spikes are then simply inserted by a force fit. These spikes can then advantageously be made in a rigid manner of polished metals; notably of aluminum or stainless steel which is chemically inert with the skin. Alternatively, these spikes can also be made of a relatively hard elastomeric material, for example a silicone rubber.

Alternatively, the pain-soothing elements can be one or several series of protuberances connected to or forming a single piece with, a base imbedded in the pedestal or at the middle or at the edge of the main base. If need be, this base can be removable.

The embodiment of the preceding case can be simplified further by making the series of spikes fixed to a base, which is connected and fixed on the pedestal.

Alternatively, the pain-soothing elements can be one or several rods having an inverted U form connected on a pedestal, the upper bar of the U being able to be straight and protruding beyond the virtual cylinder, or being able to be corrugated or toothed with only their upper parts protruding beyond the virtual cylinder.

The rod presents, with a single holder, a series of protuberances which come to strike/massage the skin to provoke the pain-soothing effect. In addition, one can work with a certain flexibility of the upper base of the U in order to modulate the pain-soothing effect.

Alternatively, the pain-soothing elements can be protuberances produced in one piece with the external side of a pedestal base.

The series of pain-soothing protuberances is then simply produced simultaneously during molding of this pedestal. The dimensions of these protuberances, of the same material as that of the pedestal, are then chosen so that the rounded protuberances are rather rigid.

Alternatively, the pain-soothing elements can be the elongated protruding edge, if desired straight, undulating or toothed, of the oblique external side of a pedestal such as seen with respect to the tangential surface of the roller at the level of the pedestal, this protruding edge being able to be the upstream or downstream edge as seen with respect to the direction of rotation of the roller.

The transverse cross section, particularly asymmetric, of the protuberances can thus be chosen to modify the characteristics of the pain-soothing impulsions.

Preferably, one or several pain-soothing elements cited previously are fixedly mounted on a pedestal in proximity to brushes for lifting the hairs to be plucked. With respect to planes transverse to the rollers, these pain-soothing elements can be aligned or laterally offset with respect to the tufts of bristles composing a brush. One can envision a simple association of a brush and a row of pain-soothing elements, the brush being mounted either downstream or upstream of the row of elements as seen with respect to the direction of rotation of the roller, or one can envision a more elaborate association, one pair of brushes surrounding a row of elements or a row of elements surrounding one brush, for example.

One thus obtains a synergy between the pain-soothing elements equally performing a combing function to align the hairs preliminarily or immediately after a lifting brushing of the hairs which are then better gripped by the tweezers. The effectiveness of this massage-combing action is assured by the fact that the rounded tips of the pain-soothing elements remain in contact with the skin during a time substantially longer than the brushes.

Alternatively, the pain-soothing elements can be tufts of bristles connected together by cementing or bonding. One thus obtains pain-soothing elements by a simple modification of pedestals with brushes that are already available. In addition, according to the quality of the cement selected, epoxy, Araldite®, or elastomeric cement, these pain-soothing elements can be hard or semi-rigid. When the extremity of a tuft is semi-rigid, an angle of attack greater than 60° is acceptable, even an angle of attack of 90° with the extremities of the bristles rounded.

Alternatively, the pain-soothing elements can be plastic protuberances overmolded on the extremities of the tufts of bristles, either semi-cylindrical or spherical protuberances overmolded on each tuft of bristles, or a protuberance in the form of a bar overmolded on the extremity of a row of tufts of bristles.

Semi-rigid pain-soothing elements are thus produced in a simple manner, notably by the fact that they are carried in a flexible manner to offer a possibility of a whipping movement.

Alternatively, one or several series of protuberances are connected on, or molded with, a base embedded in a pedestal itself carrying one or several brushes.

By separately fabricating the brushes and the pain-soothing elements, one can optimize their mode of construction and their respective characteristics by the choice of materials and dimensions. A simple final assembly by interfitting or cementing permits obtaining a completed pedestal.

BRIEF DESCRIPTION OF THE DRAWINGS

The invention will be better understood from a study of the embodiments provided by way of non-limiting example and illustrated in the attached figures in which.

BEST MANNER OF CARRYING OUT THE INVENTION

Figure 1:
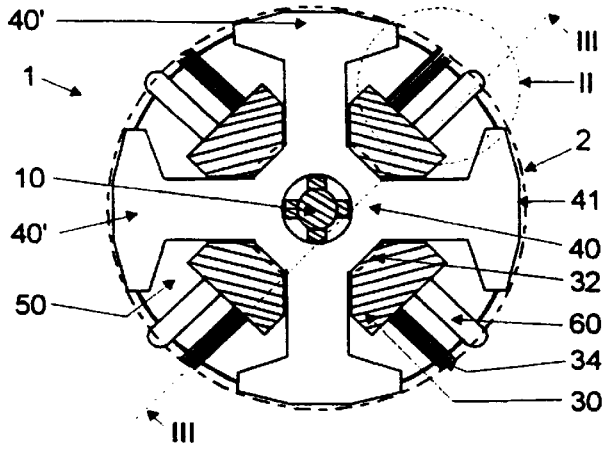
FIG. 1 is a transverse cross-sectional view of a hair-removing roller equipped with pain-soothing elements according to a first arrangement conforming to the invention.
Figure 3:
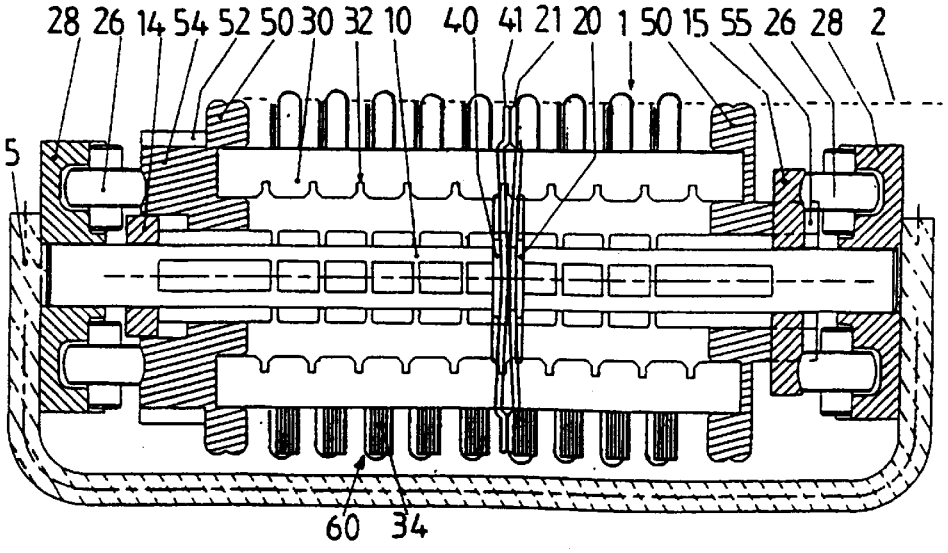
FIG. 3 is a longitudinal cross-sectional view of the hair-removing device according to FIG. 1, FIGS. 4*a* and 4*b* are schematic, perspective views of longitudinal arrangements of pain-soothing elements.

On FIGS. 1 and 3 is illustrated a hair-removing device according to document FR 97.00224, the content of which is incorporated into this description by virtue of this citation and given uniquely by way of example, as a support for the pain-soothing devices according to the invention, given of course that these pain-soothing devices can easily be adapted to other hair-removing devices, for example to that described in the Patent EP-0467733.

Succinctly, this hair-removing device comprises a rotatable roller 1 composed of a central shaft 10 moveable in rotation on a cradle 5 and of a cage mounted coaxially on the shaft which it surrounds, this cage being formed by two lateral cheeks 50 holding four pedestals 30 between them.

The left cheek 50 of the cage presents a lateral pinion 52 driven by a reducing gear passing through an orifice arranged in cradle 5 and placed in rotation by an electric motor, not illustrated, contained in the housing. This cage drives shaft 10 by notched orifices of the cheeks engaged with longitudinal teeth of the shaft.

A first series of cruciform blades 20, each blade of which constitutes a tweezing blade 20' is mounted in parallel, side-by-side at regular intervals along shaft 10. For this purpose, the teeth of shaft 10 have equidistant circular grooves. Correspondingly, the junction base of blades 20 has an orifice of a diameter identical to that of the crest of the teeth, but provided with four radial tenons oriented toward the interior and having an internal diameter identical to that of the longitudinal tooth base. These blades 20 are thus longitudinally fixed to this shaft.

A second series of cruciform blades 40 interposed between the first is itself held by the cage, notably by grooves 32 formed in the internal radial face of axial pedestals 30, the extremities of which are held at one side and the other held in housings formed at 90 degrees on the periphery of the internal faces of cheeks 50. Each branch of cruciform blade 40 constitutes a tweezing blade 40' complementary to an adjacent tweezing blade 20'.

The shaft 10 holding the first series of cruciform blades 20 and the cage 30, 50 holding the second series of blades 40 axially moveable in the opposite sense with respect to one another in addition to their common rotating movement within cradle 5. For this, there is provided on the one hand, on each external side of cheek 50, a device of identical interfitting crossed cams, but with one 14/54 offset by a quarter turn with respect to the other 15/55; and on the other hand, facing each crossed cam device, a pair of wheels 26 diametrically opposite with respect to shaft 10 and installed in a wheel-supporting disc 28 situated at the extremity of the roller against the corresponding arm of cradle 5.

Figure 2:
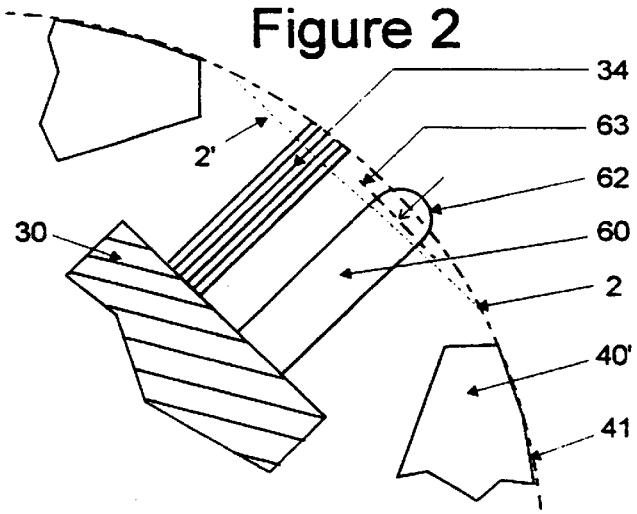
FIG. 2 is an enlarged view of the zone II of FIG. 1.

As is clearly shown in FIGS. 1 to 3, the external sides of pedestals 30 carry brushes 34 whose extremities are inscribed in a virtual protection cylinder 2 in which are also inscribed the tweezing edges 21 and 41 of tweezing blades 20' and 40' respectively. These brushes 4 lift the hairs to be removed slightly before they are gripped by the tweezers 20', 40'. As shown, each brush 34 comprises a row of tufts, for example with a diameter between 1 and 2 mm, composed of supple bristles.

In fact, and as better seen in FIG. 2, the user's skin can be led to penetrate slightly into virtual cylinder 2 between two rows of blades as schematically illustrated by the line 2'.

More particularly according to the invention, roller 1 equally comprises fixed elements 60 whose external extremities form rounded protuberances 62 extending radially outwardly from protection cylinder 2. These protuberances 62 of elements 60 are provided to come to pass on the skin in the rhythm of the rotation of the roller in a manner to effectuate a massage creating an additional pain masking that of the hair removal.

As better seen in FIG. 2, the base 63 of the rounded part 62 of the extremity of the pain-soothing element 60 can be located slightly within the virtual cylinder 2 previously defined, for example being found rather at the level of line 2'.

Then, the rounded protuberance 62 of the pain-soothing element, arriving at high speed enters into contact with the skin along an oblique face and effectuates a powerful massage having a pain-soothing effect. This massage is effectuated by a contact, a penetration into the skin and a progressive withdrawal.

These elements 60 constitute in addition a sort of comb of which the massage and combing action are complementary to the action of lifting the hairs by brushes 34. In effect, with only one row of brushes, a certain number of hairs can escape taking into account their spacing. Moreover, certain hairs pressed against the skin during the brushing can remain momentarily flattened against it and escape the plucking. The pain-soothing elements according to the invention, arranged in the manner of a comb, permit taking up the hairs and better orienting them before or after their brushing. The effectiveness of this massage-combing action is assured by the fact that the rounded tips of the pain-soothing elements remain in contact with the skin during a time substantially longer than the brushes, i.e. that they come in contact with the skin before the brushes and terminate contact after the brushes. The height of these pain-soothing elements greater than that of the brushes, accomplishes precisely this effect.

Figure 4A:
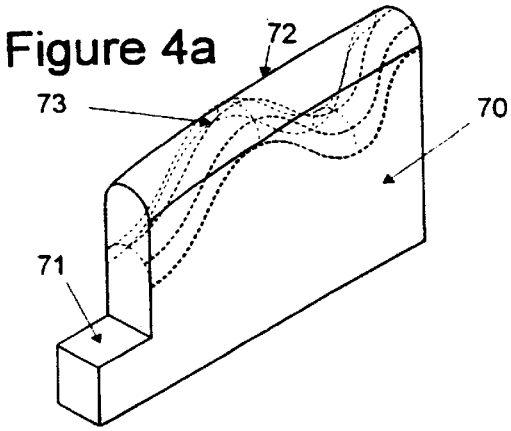

FIG. 4*a* illustrates an arrangement of pain-soothing elements in the form of a plate 70 which replaces a pedestal 30, its extremity tenons 71 coming to engage in the housing of the internal faces of the cheeks. This plate 70 can present a width of the order of 5 mm corresponding to that of a pedestal, and a radial height of the order of 5 to 6 mm in such a manner that its external rounded edge 72 of plate 70 protrudes beyond a virtual cylinder 2, for example to a height comprised between 0.1 and 1 mm. If desired, the external edge 73 can be undulating, only the upper crests of the undulations protruding beyond the virtual cylinder. This plate can be rigid, particularly when made of a metal or nylon, or can have a certain flexibility.

Figure 4B:
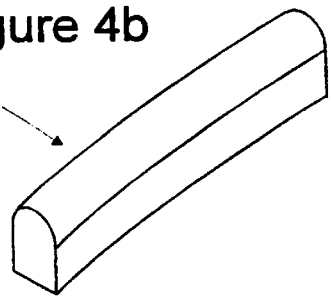

FIG. 4*b* illustrates an alternative in the form of a bar 75 arranged above pedestals 30 and the extremities of which are engaged at one side and the other in supplemental housings arranged in the internal faces of the cheeks, a little above those of pedestals 30. The protruding upper edge of this bar with a rounded transverse cross section can be linear, in the form of a circular arc, or equally undulating. This bar is preferable relatively rigid.

Figure 5:
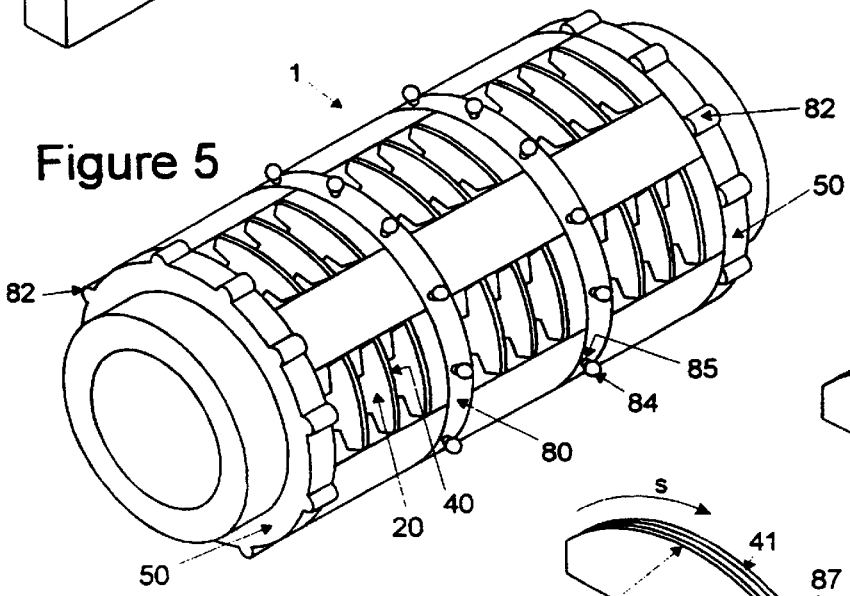
FIG. 5 is a schematic, perspective view of a hair-removing roller with a transverse arrangement of pain-soothing elements.

FIG. 5 illustrates a roller 1 comprising an arrangement of pain-soothing elements on the circular peripheral edge of intermediate discs 80 transverse to the axis of rotation of the roller and separating groups of tweezing blades 20/40 and/or on the circular peripheral edge of lateral cheeks 50. These pain-soothing elements can be ribs 82 having a substantially semi circular cross section as shown on cheeks 50. These ribs 82 are then preferably molded in one piece with the intermediate discs or cheeks. Alternatively, these pain-soothing elements can be balls 84, for example of plastic, carried by shanks 85 which are then preferably force fitted into orifices previously arranged in the edges.

The ribs 82 or balls 84 protruding from the peripheral edges define the protection cylinder with a radial height comprised between 0.1 and 1 mm. For a roller turning at a speed of the order of 1500 rpm, four to six ribs, regularly distributed on the circular periphery create a pain-soothing massage with a frequency of 100 to 150 Hz. This frequency can be changed by increasing or reducing the number of ribs or balls along this periphery.

Figure 6A:
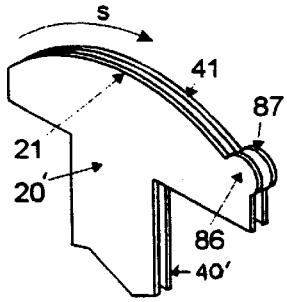
FIGS. 6*a* and 6*b* are schematic, perspective views of arrangements of pain-soothing elements on the grasping edges of a pair of tweezers.
Figure 6B:
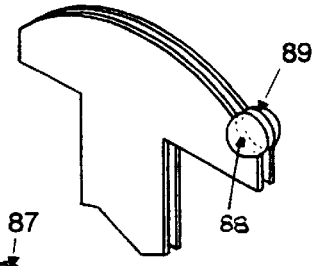

FIGS. 6*a* and 6*b* illustrate an arrangement of pain-soothing elements directly on the tweezing edges 21, 41 of blades 20', 40'. According to a preferred embodiment illustrated in FIG. 6*a*, tweezers 20', 40' of metal present semi-circular protuberances 86, 87 at their downstream attack edge, when viewed with respect to the sense of rotation(s) of the roller, these protuberances 86, 87 being formed directly during a cutting of the blade in sheet metal. Alternatively, these pain-soothing elements can be present in the form of two half spheres 88, 89 of polished metal embedded or connected to face one another by soldering on blades 20', 40'. The pain-soothing effect is thus provoked a very short time before the hair-removal pain.

Figure 7A:
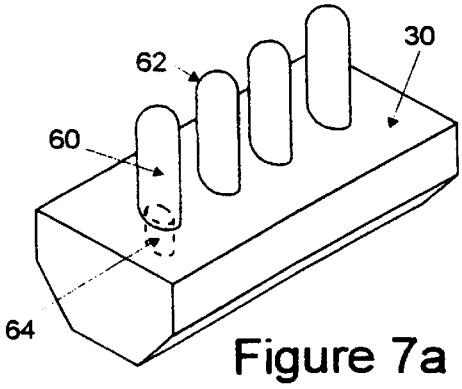
FIGS. 7*a* and 7*b* are schematic, perspective views of arrangements of pain-soothing elements on pedestals present in the hair-removing roller, such as that of FIGS. 1 to 3, FIGS. 8*a* to 8*f* are schematic, perspective views of various embodiments of pedestals carrying rigid pain-soothing elements.
Figure 7B:
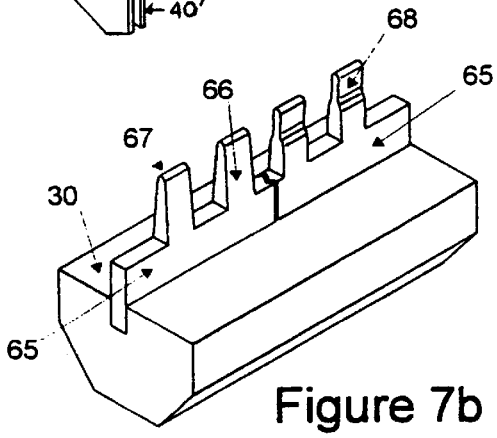

FIGS. 7*a* and 7*b* illustrate an arrangement of pain-soothing elements directly on pedestal 30, as in the example of the hair-removing roller illustrated in FIGS. 1 to 3.

FIG. 7*a* illustrates a plurality of individual spikes 60 of metal obtained by cutting a wire having a diameter comprised between 1 and 2 mm. The upper rounded extremity 62, for example hemispheric, of a spike can be obtained by an operation of stamping the extremity of the wire after cutting of a new spike. Usefully, the lower extremity 64 presents a reduced diameter in such a manner as to establish at a predetermined value the apparent height of spike 60 above pedestal 30.

The left-hand part of FIG. 7*b* illustrates a pain-soothing element in the form of a comb comprising fingers 66 having a rounded extremity 67 connected by a lower bar 65 fitted into a groove formed in the upper external face of base 30. The right-hand part of this same figure illustrates a similar pain-soothing element of which the rounded extremity 68 of the fingers is thinned to have a relative flexibility. These combs are for example made by molding under pressure of a plastic material in a mold.

FIGS. 8*a* to 8*f* illustrate the association on pedestals 30 of rigid pain-reliving elements with elongated brushes 78 formed by a row or alignment of tufts 79 composed of flexible bristles. Of course, the structures of FIGS. 7*a* and 7*b* can be produced by molding of the pedestal and of the pain-soothing devices in one piece.

Figure 8A:
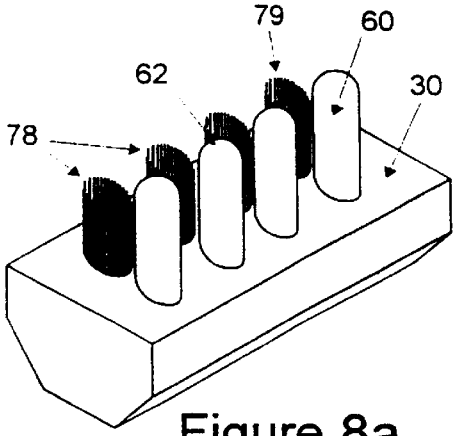

On FIG. 8*a*, the pain-soothing elements are present in the form of individual metal spikes 60 facing each tuft 79. According to an important characteristic of the invention, the upper rounded extremity 62 of a spike exceeds the extremity of a tuft by a height comprised between 0.1 and 1 mm, preferably around 0.5 mm for an effective pain-soothing effect.

Figure 8B:
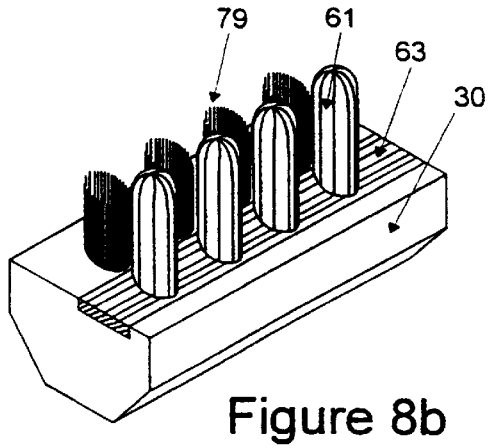

On FIG. 8*b*, the pain-soothing elements are present in the form of a series of spikes 61 of plastic molded with a base tongue 63 fitted into the upper face of pedestal 30. During mounting of these spikes, one can either arrange them to face the tufts of bristles 79, or in a staggered fashion.

Figure 8C:
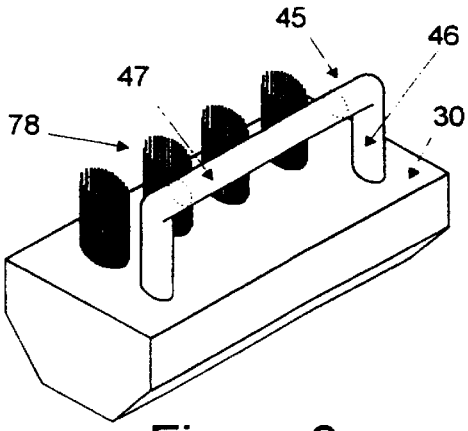

On FIG. 8*c* is illustrated a pain-soothing element 45 in the form of an inverted U-shaped rod comprising an upper rigid massage bar 47 which is straight and has a rounded transverse cross section, this bar being held at one end and the other by two feet 46 fitted into pedestal 30. This rod 45 can be produced by cutting then bending a section of metal wire. The diameter of this wire is selected as a function of the length of pedestal 30, in such a manner that bar 47 is rigid. The upper rounding of bar 47 extends beyond the extremities of the tufts of bush 78 by a height comprised between 0.1 mm and 1 mm, preferably around 0.5 mm.

Figure 8D:
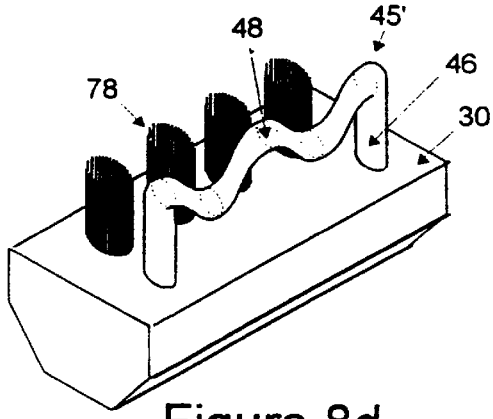

On FIG. 8*d* is illustrated a pain-soothing element 45' similar to the preceding, aside from the fact that bar 48 presents undulations of which only the upper peaks extend beyond the virtual protection cylinder. The section of metal wire is then stamped.

Figure 8E:
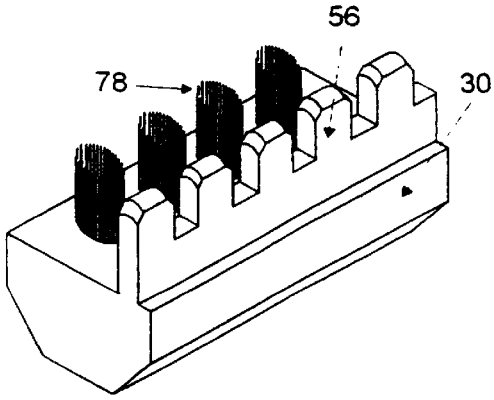
Figure 8F:
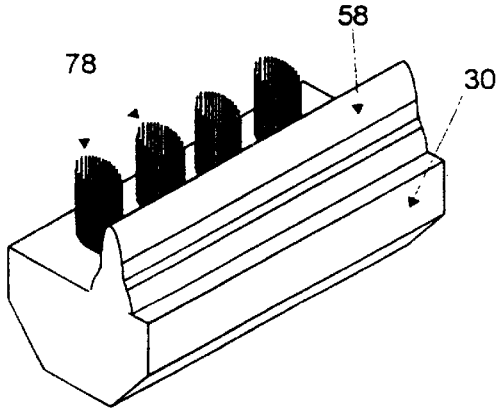

FIGS. 8*e* and 8*f* illustrate rigid pain-soothing elements 56 and 58 molded in one piece with base 30. Element 56 is present in the form of a comb with a series of teeth having rounded extremities forming distinct protuberances, while element 58 has a straight upper edge with a tapered transverse cross section terminating by a roundness. The rounded extremities of rigid elements 56 and 58 extend past brushes 28 by a height comprised between 0.1 mm and 1 mm.

Figure 9A:
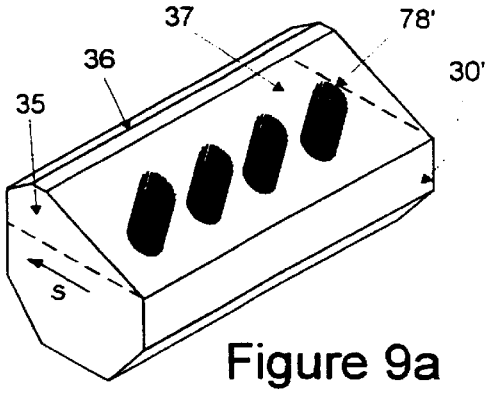
FIGS. 9*a* and 9*b* are schematic, perspective views of various embodiments of pedestals whose longitudinal edges are arranged as pain-soothing elements.

FIG. 9*a* illustrates a pedestal 30' whose downstream edge 35, as viewed with respect to the sense of rotation(s) of the roller, is raised to constitute a rigid massage element creating a pain-soothing effect. The crest 36 of this downstream edge is softened by several longitudinal planes giving a substantially rounded transverse cross section. The rear upstream face 37 carries a brush 78' which, as illustrated, can be oblique toward the rear. In this case, the pain-soothing effect precedes the brushing effect. This pain-soothing element is obtained by simple modification of the mold for fabricating a pedestal 30'.

Figure 9B:
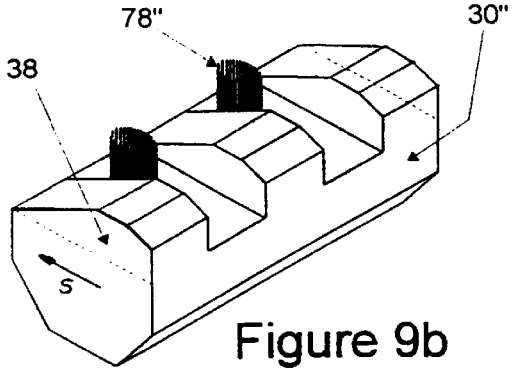

FIG. 9*b* illustrates a pedestal 30" of which the upstream edge 38 is raised and notched to compose a rigid pain-soothing element whose action follows immediately that of brushing by a series of brushes 78" arranged along the downstream edge.

Figure 10A:
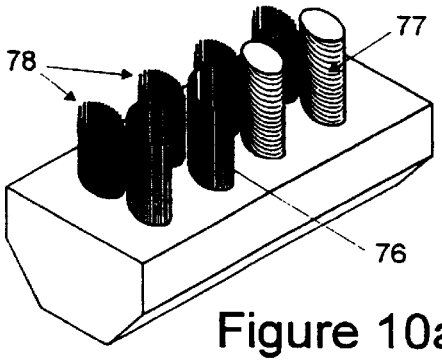
FIGS. 10*a* to 10*e* are schematic, perspective views of various embodiments of pedestals carrying semi-rigid pain-soothing elements including tufts of bristles.

FIG. 10*a* illustrates another embodiment of pain-soothing elements consisting of cementing the bristles of each tuft of a second brush arranged parallel to a brush 78 for lifting the hairs. For example, the bristles of tuft 76 are cemented with a cement of the elastomer type giving a semi-rigidity to this new element. Inversely, the bristles of tuft 77 are coiled and cemented with a cement of the epoxy or acrylic type to assure a substantial rigidity for this new element.

Figure 10B:
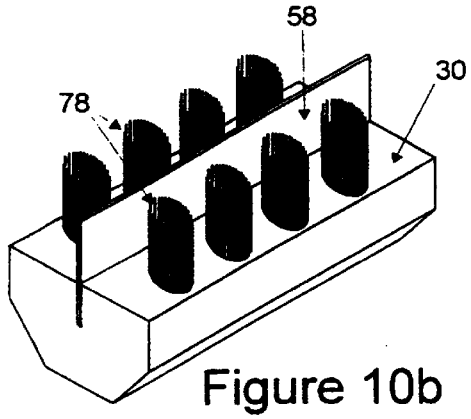

FIG. 10*b* illustrates a pain-soothing element in the form of a rigid or semi-rigid tongue 58 whose upper edge is rounded, and whose lower edge is seated in a pedestal 30 between two lifting brushes 78.

Figure 10C:
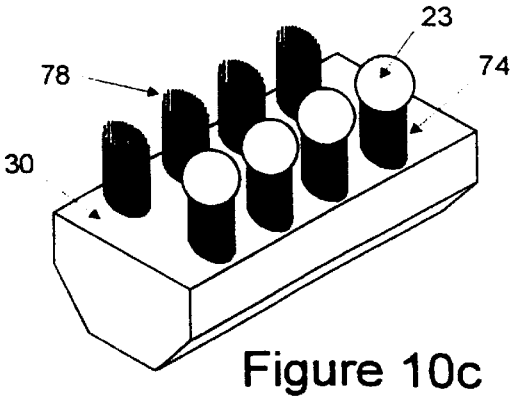
Figure 10D:
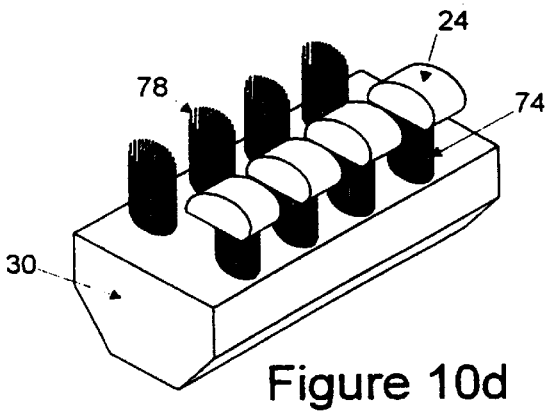
Figure 10E:
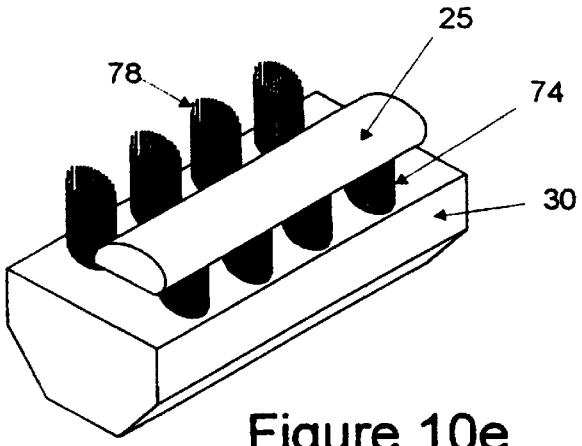

FIGS. 10*c*, 10*d* and 10*e* illustrate semi-rigid pain-soothing elements based on a molding of a plastic head at the extremity of tufts of bristles. FIG. 10*c* illustrates plastic spheres 23 overmolded on the tops of support tufts 74. FIG. 10*d* illustrates cylindrical sections 24 overmolded on the tops of support tufts 74, in such a manner as to be oriented in planes transverse to the axis of rotation of the roller. FIG. 10*e* illustrates a bar having a longitudinal cross section of a cylinder carried by a plurality of support tufts 74, the rounded convex face being oriented radially toward the outside.

For these semi-rigid pain-soothing elements 23, 24 and 25, one can provide an excess height with respect to that of brushes 78 which can reach around 2 mm without risk of injury during massaging.

Figure 11A:
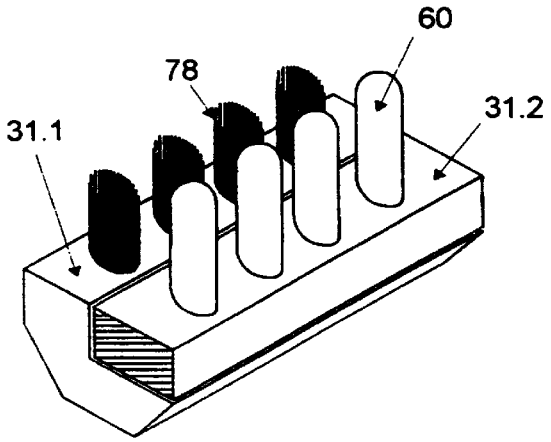
FIGS. 11*a* and 11*b* are schematic, perspective views of various embodiments of pedestals with a second piece carrying pain-soothing elements.
Figure 11B:
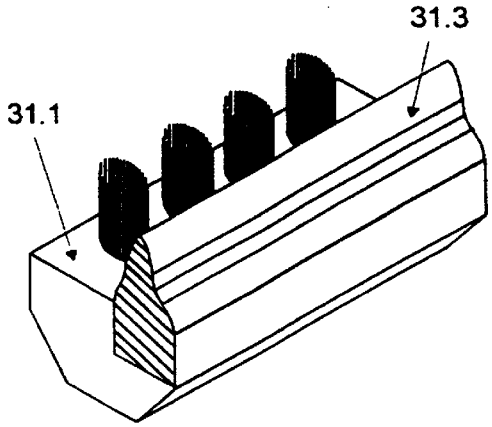

FIGS. 11*a* and 11*b* illustrate two embodiments of pedestals made of two distinct pieces molded or machined separately, then assembled. FIG. 11*a* shows a first pedestal part 31.1 carrying brushes 78, for example cut from a first plastic, assembled to a second part 31.2 carrying pain-soothing elements 60 molded in one piece. FIG. 11*b* shows a part 31.3 extruded along a profile giving at its upper edge a function of semi-flexible massage tongues, this part being then cut to the necessary length.

The invention is not in any way limited strictly to the embodiments described previously, but encompasses numerous modifications or improvements, particularly with respect to form and dimensions. Notably, one can envision that the spikes 60 present an overall form of a conic frustum. In addition, it is well understood that one can combine together the pain-soothing elements, and their supports illustrated in FIGS. 4 to 11.

POSSIBILITIES OF INDUSTRIAL APPLICATION

The invention finds its application in the technical field of hair-removal devices and more particularly in that of mass produced devices.

What is claimed is:

1. Hair-removing device comprising:

a hair-removal roller driven in rotation by a motor around an axis of rotation arranged behind a housing window, said roller comprising a plurality of tweezing blades arranged in at least one row, each of said tweezing blades having a tweezing edge;

control means for successively leading said tweezing blades to close against one another in order to tweeze hairs to be plucked and then to separate from one another; and a pain-soothing device comprising elements mounted on said roller, wherein said elements are mounted in a fixed position on said roller and each element has at least one protuberance extending beyond a virtual cylinder coaxial with said roller and in which are inscribed said tweezing edges of said tweezing blades, each said protuberance has an outer end that is at least one of inclined and rounded along a plane that is transverse to the axis of rotation of said roller and that passes through said element from which said protuberance extends and each said element has a stiffness and dimensions selected to cause each said protuberance, when said roller is rotating and is disposed against a user's skin, to contact the skin and then press into the skin to perform a massaging action and to create a pain masking that of the hair removal.

2. Hair-removing device according to claim 1, wherein the outer end of each protuberance is rounded and has a base which is situated within the virtual cylinder.

3. Hair-removing device according to claim 1, wherein the outer end of each protuberance is rounded and convex.

4. Hair-removing device according to claim 1, wherein said elements are arranged on the roller in a series in an elongated zone covering substantially the length of the roller, and are distributed along one of: a straight line; a helical line; and in staggered rows.

5. Hair-removing device according to claim 1, wherein said elements are either connected on a part of said roller, or are formed in one piece with said part.

6. Hair-removing device according to claim 1, wherein said elements are rigid or semi-rigid.

7. Hair-removing device according to claim 1, wherein said elements are present in the form of at least one radial plate having an external edge, or a bar having an external edge extending parallel to the axis of rotation between lateral cheeks of said roller, said external edge of said plate or of said bar protruding beyond the virtual cylinder and being straight, undulating, or toothed.

8. Hair-removing device according to claim 1, wherein said roller comprises at least one component having a circular periphery inscribed in the virtual cylinder and said protuberances are arranged on said circular periphery.

9. Hair-removing device according to claim 1, wherein each said protuberance is formed in the tweezing edge of a tweezing blade.

10. Hair-removal device according to claim 1, wherein said roller comprises peripheral pedestals extending parallel to the axis of rotation of said roller and each having an external face, and a plurality of brushes supported by said pedestals, and wherein said elements are mounted on said external faces of said pedestals.

11. Hair-removing device according to claim 10, wherein said elements are a series of spikes individually connected on said pedestals.

12. Hair-removing device according to claim 10, further comprising a base fitted into one of said pedestals and a plurality of said protuberances are connected to, or integral with, said base.

13. Hair-removing device according to claim 10, wherein each of said elements comprises a rod in the form of an inverted U connected on one of said pedestals and having an upper bar which is straight and protruding beyond the virtual cylinder, or which is undulating or toothed with only upper parts protruding beyond the virtual cylinder.

14. Hair-removing device according to claim 10, wherein each of said pedestals has an oblique external face and each of said elements constitutes a protruding elongated edge of the oblique external face of a respective one of pedestals, said protruding elongated edge of said oblique external face of each of said pedestals being an upstream or downstream edge of said oblique external face as viewed with respect to the sense of rotation of said roller, and said protruding elongated edge of said oblique external face of each of said pedestals is straight, undulating, or toothed.

15. Hair-removing device according to claim 10, said elements are tufts of bristles joined together by cementing or bonding.

16. Hair-removing device according to claim 10, further comprising a plurality of tufts of bristles, each tuft having an extremity, and wherein said elements consist of said protuberances and each of said protuberances is carried on the extremity of at least one tuft of bristles.

17. Hair-removing device comprising:

a hair-removal roller driven in rotation by a motor around an axis of rotation arranged behind a housing window, said roller comprising a plurality of tweezing blades arranged in at least one row, each of said tweezing blades having a tweezing edge;

control means for successively leading said tweezing blades to close against one another in order to tweeze hairs to be plucked and then to separate from one another; and a pain-soothing device comprising elements mounted on said roller, wherein said elements are mounted in a fixed position on said roller and each element has at least one protuberance extending beyond a virtual cylinder coaxial with said roller and in which are inscribed said tweezing edges of said tweezing blades, each said protuberance has an outer end that is at least one of inclined and rounded along a plane that is transverse to the axis of rotation of said roller and that passes through said element from which said protuberance extends, and each said element has a stiffness and dimensions selected to cause each said protuberance, when said roller is rotating and is disposed against a user's skin, to contact the skin and then press into the skin to perform a massaging action and to create a pain masking that of the hair removal.

* * * * *